United States Patent [19]

Heymann et al.

[11] Patent Number: 4,621,739

[45] Date of Patent: Nov. 11, 1986

[54] TRAY FOR GLASS RACKS

[76] Inventors: Mark S. Heymann, 3721 39th St., NW., Washington, D.C. 20016; Richard Gagliardi, 479 62nd St., Newport Beach, Calif. 92663

[21] Appl. No.: 560,505

[22] Filed: Dec. 12, 1983

[51] Int. Cl.[4] ..... A47B 73/00

[52] U.S. Cl. ..... 211/74; 211/181

[58] Field of Search ..... 211/74, 71, 126, 128, 211/133, 181; 220/19, 69

[56] References Cited

U.S. PATENT DOCUMENTS

| | | | |
|---|---|---|---|
| 519,736 | 5/1894 | Reid . | |
| 524,912 | 7/1895 | Wood . | |
| 934,721 | 9/1909 | Garretson . | |
| 1,023,982 | 4/1912 | Barnes . | |
| 1,088,642 | 2/1914 | Wilcox | 211/74 |
| 1,279,033 | 9/1918 | Stollberg . | |
| 1,407,066 | 2/1922 | Johnson . | |
| 1,569,157 | 1/1926 | Thompson | 211/74 X |
| 1,904,969 | 4/1933 | Cavano et al. | 211/181 X |
| 1,985,508 | 12/1934 | Lasell . | |
| 2,213,918 | 9/1940 | Lofstrand | 211/74 X |
| 2,539,024 | 1/1951 | Leiby . | |
| 2,550,355 | 4/1951 | James | 211/181 X |
| 2,646,809 | 7/1953 | Van Hise | 211/74 X |
| 2,741,392 | 4/1956 | Weiss . | |
| 2,743,029 | 4/1956 | Mautner . | |
| 2,768,022 | 10/1956 | Pope . | |
| 2,799,426 | 7/1957 | Kaye . | |
| 3,009,579 | 11/1961 | Ettlinger, Jr. . | |
| 3,179,277 | 4/1965 | Olson et al. . | |
| 3,203,557 | 8/1965 | Ettlinger, Jr. . | |
| 3,217,890 | 11/1965 | Maslow . | |
| 3,333,722 | 8/1967 | Panknin . | |
| 3,348,723 | 10/1967 | Wilson . | |
| 3,433,357 | 3/1969 | Nolte . | |
| 3,811,747 | 5/1974 | Levin . | |
| 3,954,293 | 5/1976 | Orr . | |

*Primary Examiner*—J. Franklin Foss
*Assistant Examiner*—Sarah A. Lechok Eley
*Attorney, Agent, or Firm*—Parkhurst & Oliff

[57] ABSTRACT

A tray for collecting waste fluid from glasses prior to washing in an automatic dishwasher, consisting of four walls, a bottom of ribbed construction, and a plurality of attaching means to attach the tray to the glass rack.

11 Claims, 8 Drawing Figures

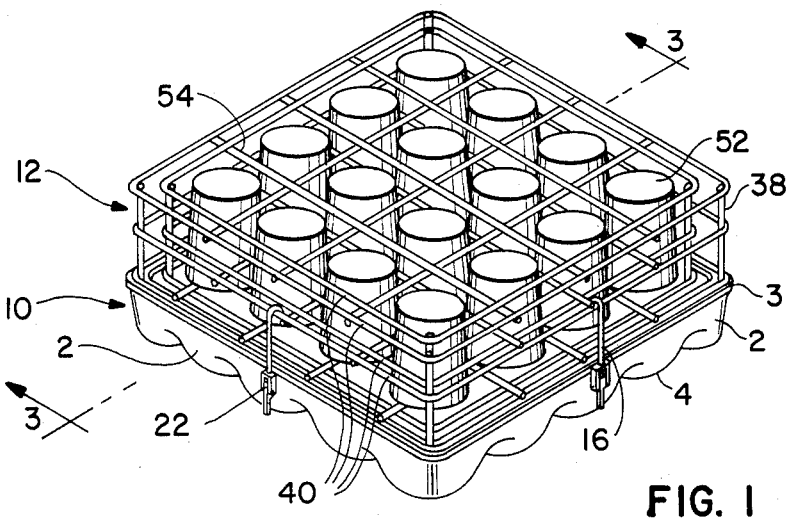
FIG. 1
FIG. 2
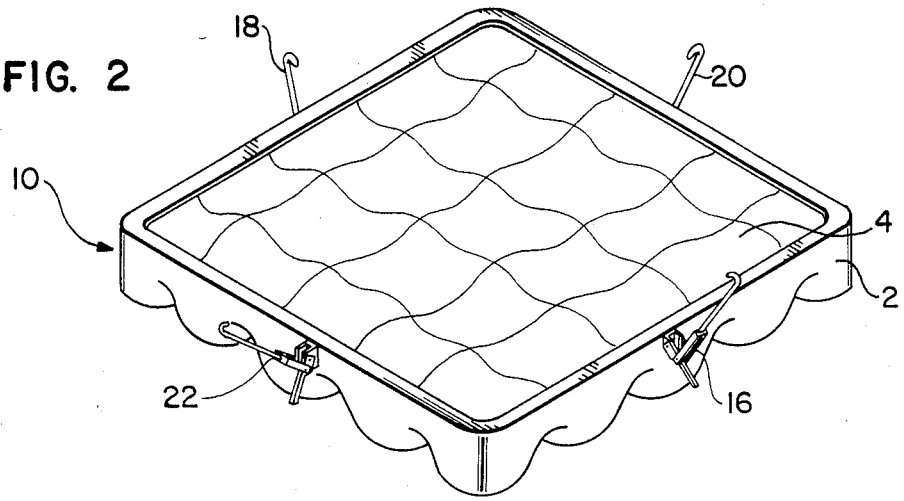
FIG. 3
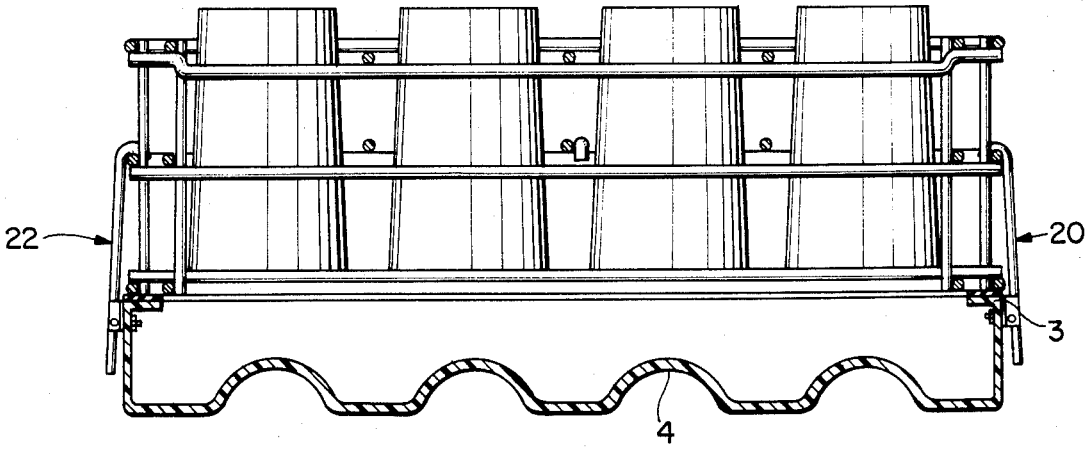

TRAY FOR GLASS RACKS

BACKGROUND AND SUMMARY OF THE INVENTION

This invention relates to a tray for catching liquid and debris from glasses in glass racks for automatic industrial dishwashers.

Glass or dish racks per se are known. In using such glass racks, restaurants and catering halls manually stack or clutch soiled tableware when removing the soiled tableware from tables within the dining area, brush or empty debris from the soiled tableware into a container and then insert the soiled articles into the glass or dish rack for cleaning. Such a process is cumbersome and permits liquid or solid debris from soiled tableware to spill in the dining area. In addition, such a process results in excessive breakage of tableware.

However, restaurants have needed an efficient, preferably one-step process and associated apparatus for cleaning or bussing dirty or soiled tableware from tables within a dining area without breakage of tableware or spilling any debris contained within the soiled tableware, and inserting the soiled tableware into a rack for cleaning within or by a dishwasher. To provide such an efficient process, the present invention relates to a debris-holding tray detachably secured beneath a conventional glass rack and a table clearing method. The tray and glass rack are carried as a unit to a table in a dining area in need of clearing. The tray catches liquid or solid debris expelled from soiled articles as the articles are directly inserted into the rack. Breakage of tableware is minimized by directly inserting the tableware into the glass or dish rack. The tray and glass rack are then carried or conveyed as a unit to a dishwasher whereupon the rack is detached from the tray. The rack is inserted into the dishwasher for cleaning the soiled articles and the tray is then attached to an empty rack for continuing the table clearing operation.

It is an object of the present invention to provide a tray attachable to conventional glass racks for automatic dishwashers for catching debris and water from inverted glasses prior to washing drinking glasses. The tray comprises four walls and a bottom and means for attaching the tray to a conventional glass rack.

It is another object of the present invention to provide a rapidly attaching, manually releasable tray with a ribbed or corrugated bottom that prevents wave motion of waste liquid poured into the tray.

It is another object of the present invention to provide a means wherein the tray can be quickly secured to the glass rack with said means located on oppositely disposed walls of the tray, said means being adapted to fasten the tray in place to the glass rack.

Other objects of the present invention are to provide a quick, one-step method for moving glasses or cups from tables in restaurants to the dishwasher apparatus, and to provide a device which is of simple construction, is inexpensive to manufacture, has a minimum number of parts which are easily replacable, is easy to use and is efficient in operation.

BRIEF DESCRIPTION OF THE DRAWINGS

For other objects and a better understanding of the invention, reference may be had to the following detailed description taken in connection with the accompanying drawings:

FIG. 1 is a perspective view of the tray attached to a wire glass rack with glasses in an inverted position permitting the glasses to drain into the tray, and, attaching means on opposing sides of the tray;

FIG. 2 is a perspective view of the tray with releasably detachable attaching means;

FIG. 3 is a sectional view taken along line 3—3 of FIG. 1;

DETAILED DESCRIPTION OF THE PREFERRED EMBODIMENTS

Figure 4:
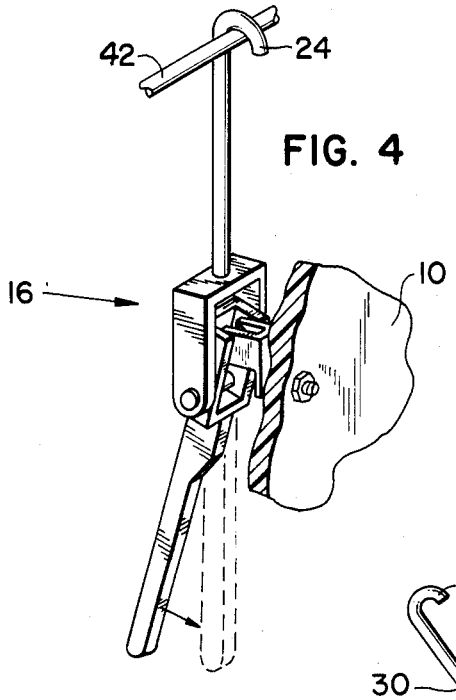
FIG. 4 is an enlarged perspective view of one of the attaching means in a closed and partially released position.

Referring now in more detail to the drawings wherein similar reference numerals identify corresponding parts throughout the several views, FIG. 1 illustrates a wire glass rack (12) for holding inverted glasses or cups (52) and said glass rack attached to a tray (10) by a plurality of attaching means (16), (18), (20) and (22) with the tray (10) having side walls (2) and a bottom (4).

The tray (10), as shown in FIGS. 1 and 2, includes at least four substantially vertical side walls (2) and a bottom (4). The tray is designed to hold liquid waste and debris from inverted glasses and cups. The bottom (4) of the tray is ribbed or corrugated so as to prevent sloshing and wave motion by the liquid waste water during movement of the tray, as illustrated in FIGS. 2 and 3. The tray can be made of temperature resistant, impact resistant, rubberized plastic. Also a gasket (3) could be placed between the tray and the glass rack to insure a tight seal when the tray is locked onto the glass rack.

Figure 5:
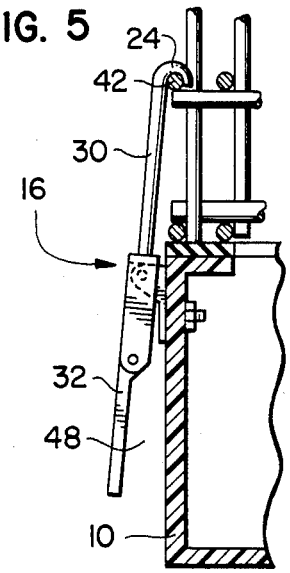
FIG. 5 is an enlarged view, partly in section, of one of the attaching means in a locked position.
Figure 6:
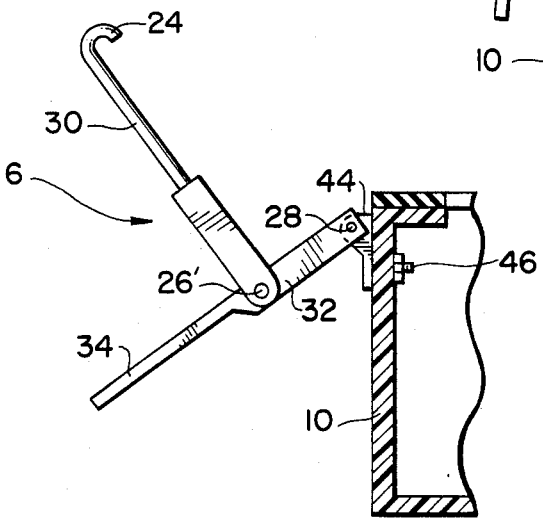
FIG. 6 is an enlarged view, partly in section, of one of the attaching means in a completely released position.

The tray is manually attachable to the glass rack by at least two or more of the attaching means (16), (18), (20) and (22). An enlarged view of a representative attaching means (16) is shown in FIGS. 4–6. The attaching means (16) is manually detachable for releasably securing the tray to the glass rack. This attaching means comprises essentially two parts as shown in FIG. 6, a first part (30) and a second part (32). The first part (30) has two ends (24) and (26). One end (24) of the first part is hooked-shaped, and functions to clasp about the middle of the side wall of the wire glass rack (42), as shown in FIG. 5. The other end (26) of the first part (30) overlaps the second part (35) and is secured to the second part (34) by a bolt or similar mechanism. The second part (32) of the attaching means (16) has two ends (28) and (34), wherein one end (28) of the second part (32) is secured by a rotatable fastening means or bolt, to a plate (44) on the tray (10). A bolt (46) could be employed to fasten the plate (44) to the tray (10). The opposite end (34) of the second part (32) is less thick than the fastening end (28) of the second part. This reduced thickness permits additional clearance space between the side wall of the tray (10) and the second part (32) such that fingers can easily slide into a space (48), as shown in FIG. 5, and thereby provide leverage to the second part (32) to manually readily release the attaching means from a locked position.

Figure 7:
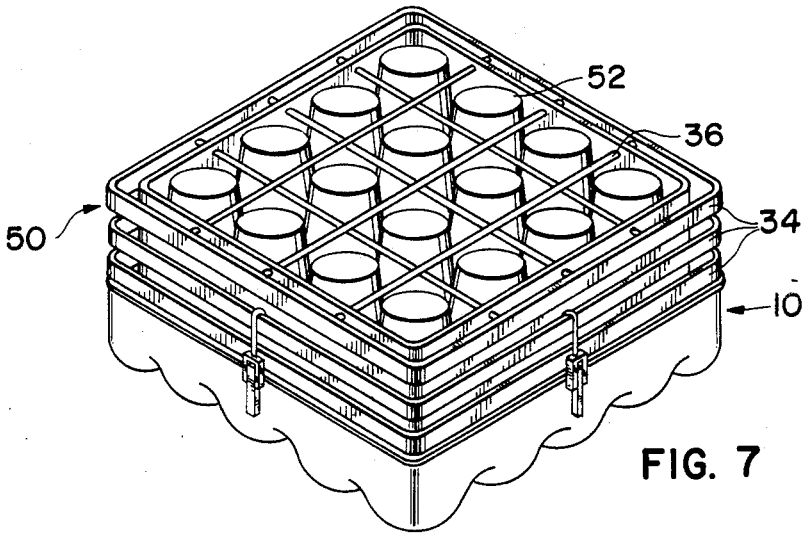
FIG. 7 is a perspective view of the tray attached to a conventional glass rack of rubberized plastic with attaching means on each side of the tray.

Alternative embodiments of conventional glass racks attached to the liquid holding tray (10) are shown in FIGS. 1 and 7.

FIG. 1 illustrates a wire glass rack (12) for holding glasses or cups (52) in an inverted position allowing them to drain. The wire glass rack comprises a wire basket of rectangular construction, having substantially vertical sides (40) and a bottom. The bottom can be of a construction such that waste debris can pass out of inverted glasses, but the glasses are retained in the basket. The basket can have rectilinear dividers made of wire (54) which would separate glasses during transport and prevent the possibility of breakage. The wire basket (12) can be constructed of wire corner posts (38) to which are attached a plurality of wires (40) to form the sides of the basket.

An alternative embodiment is shown in FIG. 7 wherein the glass rack is of rubberized plastic and comprises a molded basket, of double-walled construction, rectangular in shape that is constructed from a plurality of spaced rubberized plastic strips (34) formed to create four walls and a bottom. The bottom is of a construction that allows waste water and debris from the inverted glasses or cups (52) to flow out of the cups or glasses (52) into the liquid holding tray. The basket could further be constructed to include rectilinear dividers (36) to separate the inverted glasses in the basket and prevent possible breakage of the glassware due to impact with each other during transit.

By way of a non-limiting example, the tray of the present invention for holding waste water could be about 6 to 10 inches tall with the ribbing on the bottom about 1 to 3 inches in depth. The tray could hold up to 320 ounces of fluid poured from anywhere from 1 to 24 glasses or cups. The dimensions of the tray could, for example, be 20×20 inches or 20×10 inches. The number of attaching means for holding the tray to the glass rack could be anywhere from 2 to 8 means. The tray could preferably be of one-piece rubberized plastic construction and be able to withstand temperatures of at least 190° F. The tray could have a disposable, replacable gasket to cover the upper edge of the tray to securely seal the glass rack to the tray.

Figure 8:
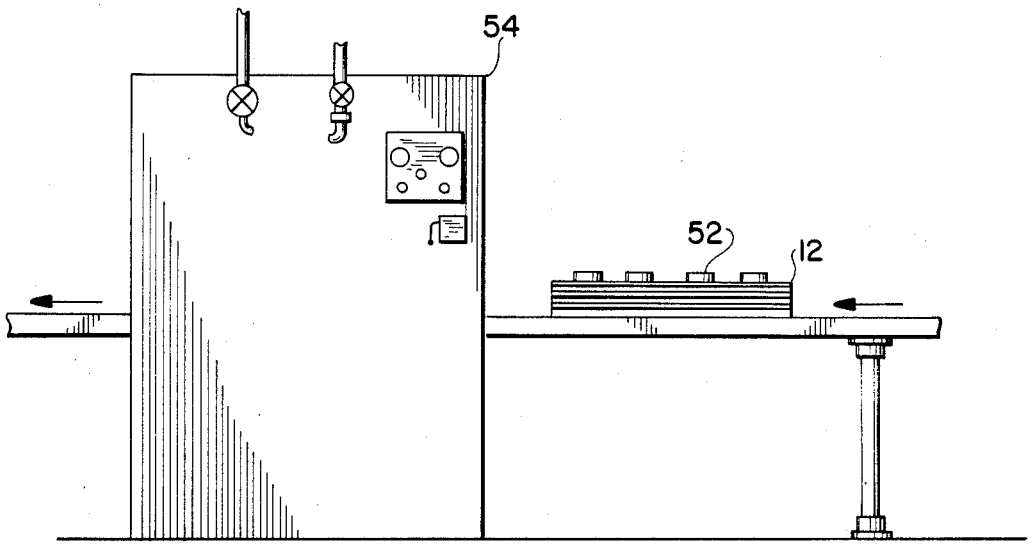
FIG. 8 is a front view of a glass rack loaded with soiled articles and detached from the debris holding tray, the glass rack being conveyed toward an automatic dishwasher.

In operation, the glass rack 12 is attached to the debris holding tray 10 and carried as a unit. Tables in a dining area are then cleared or bussed by inserting soiled articles, such as glasses 52 in FIG. 7, directly into the glass rack. Breakage of glasses is reduced by direct insertion into the glass rack, as opposed to manually stacking or clutching several glasses. Liquid waste within the glasses falls through the rack, but is contained within the debris holding tray. Further, the liquid waste does not slosh or spill from the tray upon movement from table to table, due to the corrugated base 4 and sealing gasket 3 of the tray. When loaded, the glass rack and tray are carried to a washing area. The glass rack is detached from the tray and inserted into an automatic dishwasher 54 (FIG. 8) or other device for washing tableware. Debris within the tray is emptied and the tray is then ready for attachment to another glass rack for subsequent table clearing operation.

From the foregoing, it will be apparent that there has been illustrated and described a highly novel tray assembly for attachment to glass racks for automatic dishwashers which is formed from a relatively few number of parts. The tray is of a design so as to collect waste water and debris from inverted glasses placed in the glass rack prior to washing the glasses in the automatic dishwasher. This assembly permits one-step efficient busing of table glass which no longer needs be transferred from table to tub to glass rack. The glasses can be put onto the glass rack in one step with the tray attached below the rack serving to catch the waste debris. Various changes and modifications may be made in the tray assembly of the present invention without departing from the scope of the appended claims.

What is claimed is:

1. A debris holding tray removably attached beneath a glass or dish rack having a perforated base and suitable for use in a dishwasher, said tray comprising:

a bottom member with upstanding side walls defining a top edge of said bottom member, said bottom member and said side walls retaining liquid or solid debris falling through said perforated base; and a plurality of attaching means for releasably securing said tray beneath said rack and enabling selective detachment of said rack from said tray for insertion of said rack into said dishwasher and for disposal of said debris from said tray, said attaching means being fixed to one of said tray and said rack and releasably secured to the other of said tray and said rack, a peripheral edge of said perforated base of said rack being located on the top edge of said bottom member.

2. The debris holding tray of claim 1, wherein said bottom member is corrugated for inhibiting sloshing of debris within the tray.

3. The debris holding tray of claim 1, further comprising gasket means between said top edge of said tray and said peripheral edge of said perforated base of said rack for sealing an opening therebetween.

4. The debris holding tray of claim 3, wherein the gasket means is secured to said tray.

5. The debris holding tray of claim 1, wherein said attaching means comprises a first member pivotably attached to a second member, said second member being pivotably attached to one of said tray and said rack, said first member having a hook-shaped first end and an opposite second end pivotably attached to said second member.

6. The debris holding tray of claim 5, wherein said second member is pivotably attached to said tray and said hook-shaped first end of said first member is adapted to releasably engage said rack.

7. The debris holding tray of claim 1 wherein an attaching means is located on opposing side walls of said tray.

8. A debris holding tray releasably attached beneath a glass or dish rack having a perforated base and upstanding side walls, said glass or dish rack being suitable for use in a dishwasher, said debris holding tray comprising:

a bottom with upstanding side walls defining a top edge, said bottom and said side walls defining a tray having dimensions substantially the same as said rack, said bottom and side walls retaining liquid or solid debris falling through said perforated base from soiled articles within said rack;

a plurality of attaching means secured to at least two opposing side walls of said tray for releasably engaging corresponding side walls of said rack and enabling selective detachment of said rack from said tray for insertion of said rack into said dishwasher and for disposal of said debris from said tray, said attaching means selectively securing ssaid tray to said rack to locate a peripheral edge of said perforated base of said rack on the top edge of said bottom member; and gasket means secured to the top edge of said tray for sealing an opening between said tray and said peripheral edge of said rack, said gasket means being secured to said tray.

9. The debris holding tray of claim 8 wherein said bottom is corrogated to inhibit movement of debris within said tray.

10. A debris holding tray removably attached beneath a glass or dishrack having a perforated base and suitable for use in a dishwasher, said tray comprising:

a bottom member with upstanding sidewalls, said bottom member and said sidewalls retaining liquid or solid debris falling through said perforated base, said bottom member being corrugated for inhibiting the sloshing of debris within the tray; and a plurality of attaching means for releasably securing said tray beneath said rack, said attaching means being affixed to one of said tray and said rack and releasably secured to the other of said tray and said rack.

11. The debris holding tray of claim 10, further comprising gasket means between said tray and said rack for sealing an opening therebetween.

* * * * *